US008720088B2

(12) United States Patent
Knight

(10) Patent No.: US 8,720,088 B2
(45) Date of Patent: May 13, 2014

(54) EXCAVATOR TOOTH RETENTION DEVICE

(71) Applicant: Caterpillar Inc., Peoria, IL (US)

(72) Inventor: Garrett D. Knight, Kincardine (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/914,297

(22) Filed: Jun. 10, 2013

(65) Prior Publication Data

US 2013/0269222 A1 Oct. 17, 2013

Related U.S. Application Data

(63) Continuation of application No. 12/923,491, filed on Sep. 23, 2010, now Pat. No. 8,458,931.

(60) Provisional application No. 61/272,487, filed on Sep. 29, 2009.

(51) Int. Cl.
*E02F 9/28* (2006.01)

(52) U.S. Cl.
USPC ..... 37/456

(58) Field of Classification Search
USPC ..... 37/446, 451–460; 403/374, 373, 355, 403/320, 21, 22
See application file for complete search history.

(56) References Cited

U.S. PATENT DOCUMENTS

| | | | |
|---|---|---|---|
| 4,433,496 | A | 2/1984 | Jones et al. |
| 5,410,826 | A | 5/1995 | Immel et al. |
| 5,452,529 | A | 9/1995 | Neuenfeldt et al. |
| 5,784,813 | A | 7/1998 | Balassa et al. |
| 5,868,518 | A | 2/1999 | Chesterfield et al. |
| 5,964,547 | A | 10/1999 | Brinkley |
| 6,009,644 | A | 1/2000 | Hedley |
| 6,301,810 | B1 | 10/2001 | Fidler |
| 6,986,216 | B2 | 1/2006 | Emrich et al. |
| 7,516,564 | B2 | 4/2009 | Ruvang |

*Primary Examiner* — Robert Pezzuto
(74) *Attorney, Agent, or Firm* — Finnegan, Henderson, Farabow, Garrett & Dunner LLP

(57) ABSTRACT

A tooth retention device for attachment to an excavator bucket, which has a tooth mounting portion, a fork shaped body fitting over the edge of the bucket, a clamp passing through the body and the bucket, and a wedge holding the clamp in position, in which the wedge has a threaded rod and a threaded block on the rod. The rod is rotatable to move the block between locked and released positions.

19 Claims, 5 Drawing Sheets

EXCAVATOR TOOTH RETENTION DEVICE

RELATED APPLICATIONS

This application is a continuation of U.S. patent application Ser. No. 12/923,491, filed on Sep. 23, 2010, which will issue as U.S. Pat. No. 8,458,931 on Jun. 11, 2013, which is based and claims priority to U.S. Provisional Application No. 61/272,487, filed on Sep. 29, 2009, the contents of both of which are expressly incorporated herein by reference.

FIELD OF THE INVENTION

This invention relates to excavator equipment with a bucket or shovel of the type having teeth, and in particular to a retaining device for retaining teeth on the shovel or bucket of such equipment, in which the retaining device can be fastened and released without the use of hammers.

BACKGROUND OF THE INVENTION

Excavators usually have a bucket or shovel, and teeth are attached to the leading edge of the bucket, to assist in penetrating the material. The teeth are subject to heavy wear.

They are replaced at frequent service intervals.

Tooth retention devices are provided which attach to the leading edge of the bucket.

These devices have mechanisms which secure the individual teeth. They permit the release and replacement of the teeth as required.

The tooth retention devices are also subject to heavy wear. They are releasably secured to the leading edge of the bucket. They must also be removed and replaced as required.

The invention is directed to such tooth retention devices, and to a system for attaching and releasing them without the use of hammers.

BRIEF SUMMARY OF THE INVENTION

The invention seeks to provide a tooth retention device for attachment to an excavator bucket, which has a tooth mounting portion, a forked shaped body fitting over the edge of the bucket, a clamp passing through the body and the bucket, and a wedge holding the clamp in position, in which the wedge has a threaded rod and a wedge block on the rod. The rod is rotatable to move the block between locked and released positions.

Preferably the wedge is generally tapered from a narrow end to a wider end and the clamp has a wedge engaging surface angled to receive the tapered wedge.

Preferably, the lip of the bucket is formed with an opening through which the clamp can be passed, and the lip of the bucket has a wedge engaging surface for receiving the wedge. Preferably the lip of the bucket is also formed with diverging pressure surfaces and the clamp is formed with diverging clamping surfaces, the respective surfaces being inter engageable when the wedge is inserted.

Preferably the clamp also has wedge receiving recesses, through which the wedge can be inserted between the clamp and the lip so that when the block on the wedge is tightened up, the lip and the clamp are forced apart, thereby forcing the clamp into engagement with the lip.

Preferably there is a resilient cap which can be applied to the top of the rod, and the rod has a head, receiving the cap, so as to protect the head of the threaded rod from damage.

Preferably, the threaded rod has an annular collar, and the wedge has a semi annular recess, with the collar fitting within the recess, while permitting the threaded rod to be rotated.

In a preferred embodiment of the Invention, the wedge has a wedge block with a wedge rack portion. The clamp has a clamp rack portion, the two rack portions being inter engagable securely. The wedge block has a threaded bore, and through the threaded bore, the threaded rod is connected so that the block can be tightened up.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
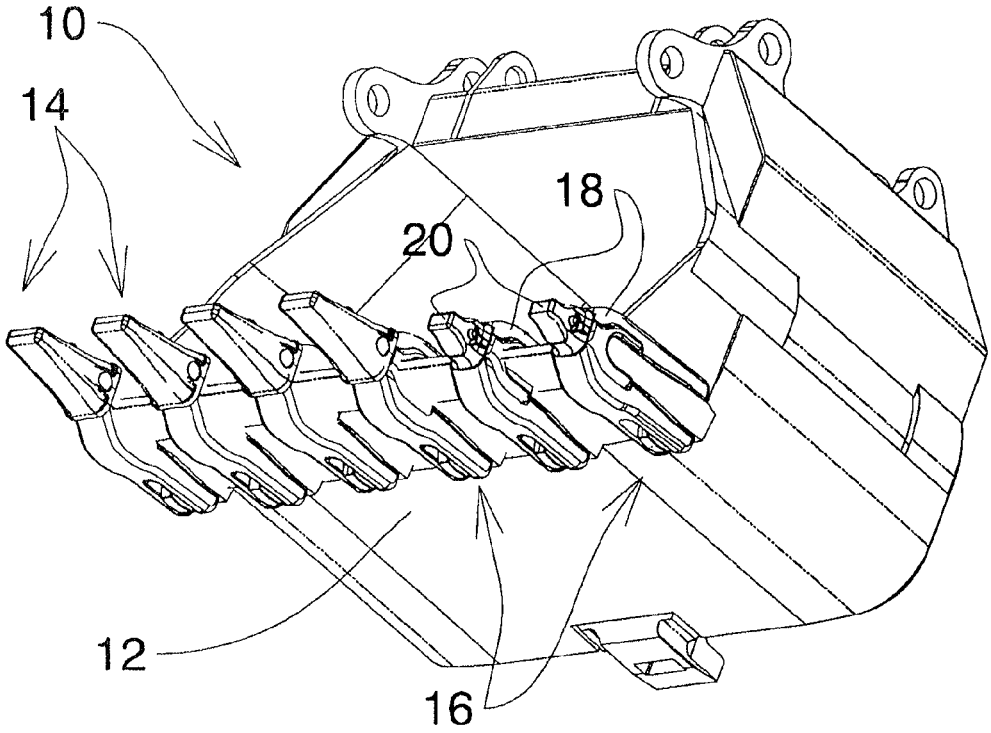
FIG. 1 is a general isometric view of an excavator bucket.

Referring to FIG. 1 it will be seen that the invention is illustrated there in relation to an excavator bucket (10). The bucket is mounted on any of a variety of pieces of excavator equipment (not shown) which require no description.

The bucket has a leading lower lip (12) provided with a plurality of tooth members (14).

Each tooth is retained on an individual tooth retention device (16).

The tooth retention devices are secured to the lip (12) at spaced intervals.

Each tooth can be attached to and removed from its tooth retention device by means known in the art and requiring no description.

The tooth retention device (16) is also releasable and replaceable, as and when required. In the past the attachment system used for this purpose, involved the use of simple metal wedge pieces, which were hammered into a space in the tooth retention device. Removal involved hammering the wedges pieces, in the opposite direction, to release them.

This was tiresome, and difficult.

The invention is directed to a tooth retention device having an improved attachment for securing the tooth retention devices to the bucket, and enabling its release for replacement in a quicker more efficient manner.

Figure 2:
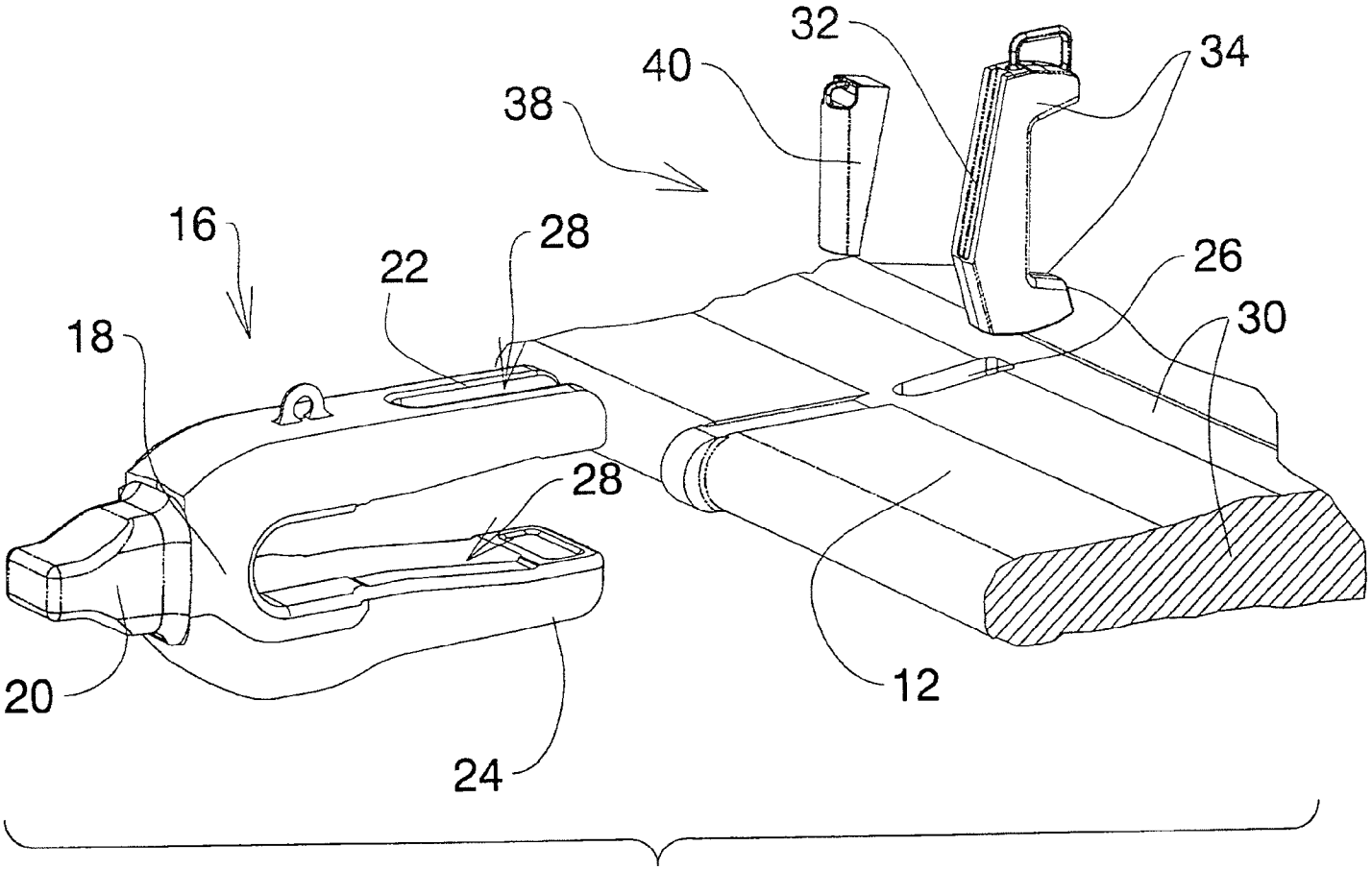
FIG. 2 is an isometric exploded view of a tooth retention device.
Figure 3:
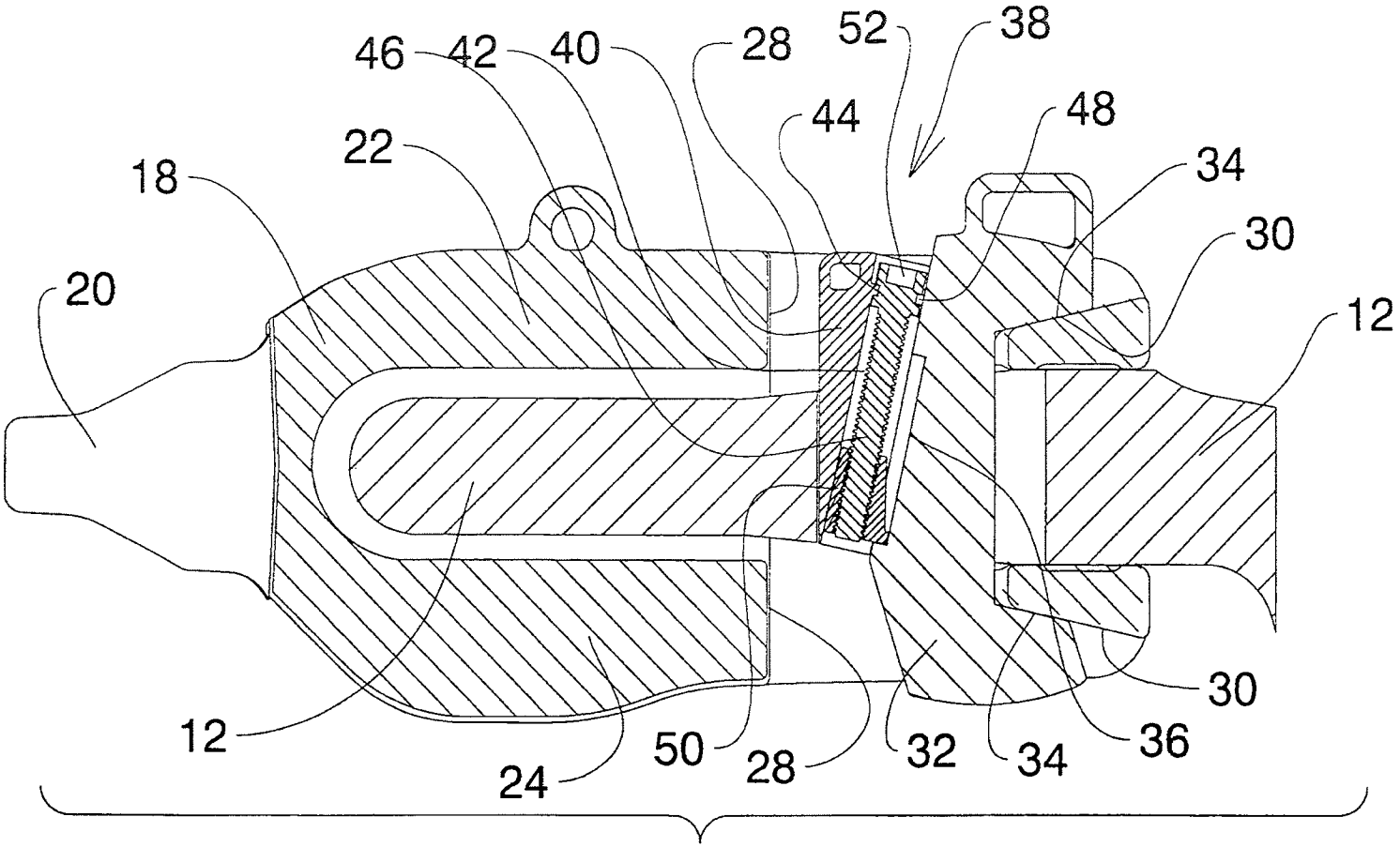
FIG. 3 is a section showing the wedge block in a first position.

A first embodiment of the tooth retention device is shown in more detail in FIGS. 2 and 3;

The tooth retention device (16) of this embodiment comprises a main body (18) having a forwardly extending tooth support (20) formed integrally. This support fits into the tooth (14) in known manner, and the tooth is secured in known manner.

Extending rearwardly from body (18) there are upper and lower arms (22) and (24), forming a fork. The arms embrace the lip (12) of the bucket (10).

The lip (12) is formed with clamp openings (26) with angled diverging forward and rearward pressure surfaces.

The arms (22) and (24) are formed with respective clamp slots (28).

C-shaped clamps (32) are shaped and adapted to fit through clamp slots (28) and through clamp openings (26) in the lip. The upper and lower edges (34) of the C clamp are formed at angles as to make a tapered wedging fit against angled surfaces (30) of lip (12).

In order to hold the C clamp (32) in position, the C clamp (32) is formed with a rectangular block space (36).

Each retention device is provided with a releasable wedge member (38).

Wedge member (38) consists of an integral wedge body (40) tapering from a wide upper end to a narrower lower end. It has a generally U-shaped channel (42), with a semi-annular ridge (44) at its upper end.

Within channel (42) there is a threaded rod (46), with an annular groove (48) for receiving the ridge (44).

A wedge block nut (50) with an internal thread fits on rod (46). A portion of block nut (50) extends out from channel (42). Rotation of rod (46) will drive the block nut (50) up or down channel (42).

The engagement of the groove (48) on the ridge (44) retains the rod (46) in a predetermined location, while allowing it to rotate for purposes described below.

In operation the arms (22) and (24) are slid around the lip (12) of the bucket, with the clamp opening (26) registering with the clamp slots (28).

A C clamp (32) is then slid through the clamp slots (28) and clamp opening (26), with its upper and lower angled surfaces (34) fitting over the angled surfaces (30).

A wedge member (38) is then slid down into the clamp slots (28) and clamp opening (26).

At this stage the wedge block nut (50) is threaded down to it lowest position on rod (46)

A suitable tool (alien key or the like) engages head (52) and is then used to rotate rod (46).

This will cause the block nut (50) to move upwardly within channel (42).

The block nut (50) will then contact the C clamp (32) within rectangular space (36).

Tightening of rod (46) will cause block nut (50) to clamp between the C clamp (32), and the lip (12) and hold the C clamp (32) firmly in position.

Removal of the retention device (16) proceeds in the opposite manner by reversing rod (46) and thus releasing the block nut (50) from the C clamp (32).

Figure 4:
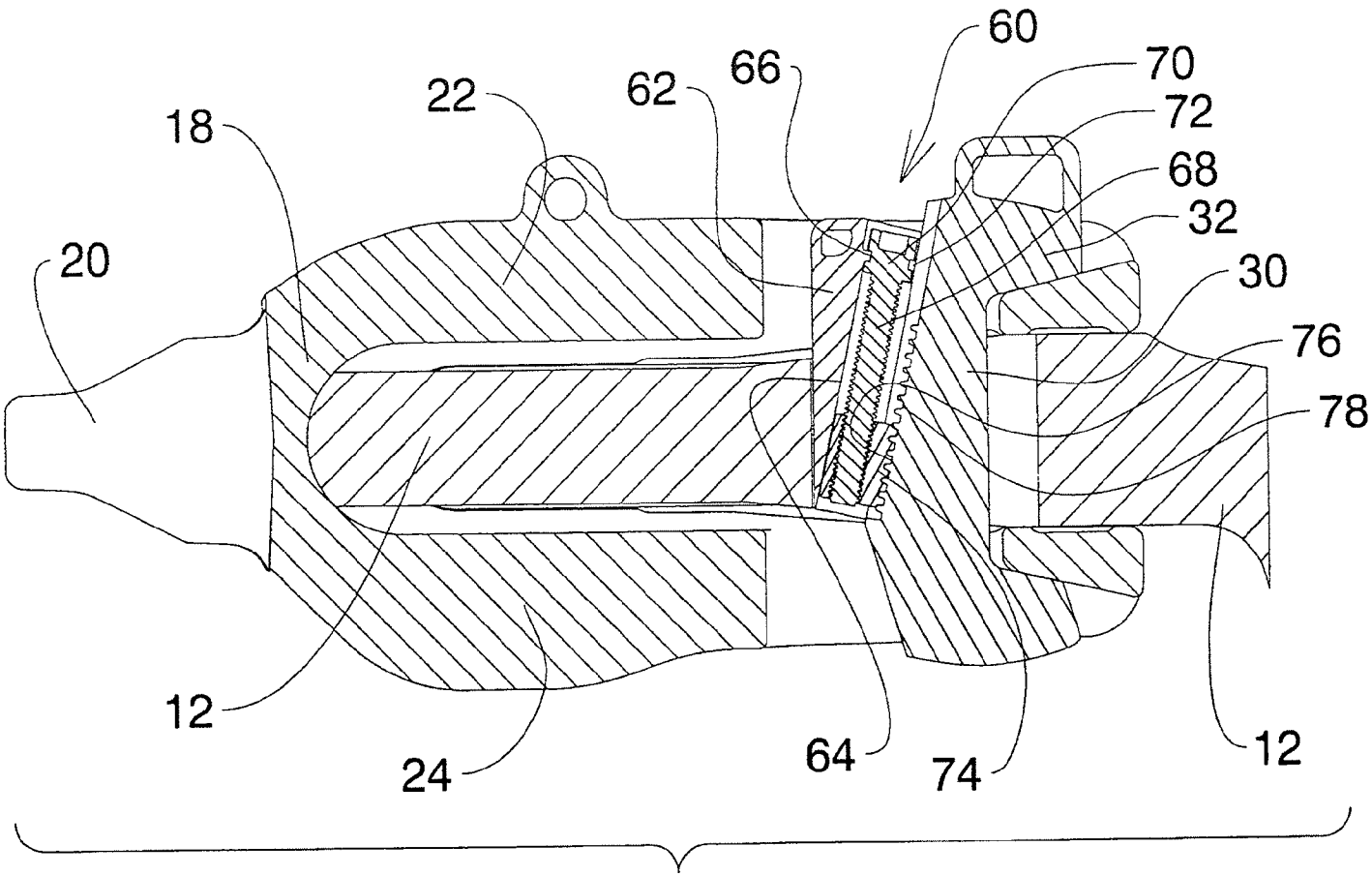
FIG. 4 is a section showing a further embodiment of the wedge block in a second position.
Figure 5:
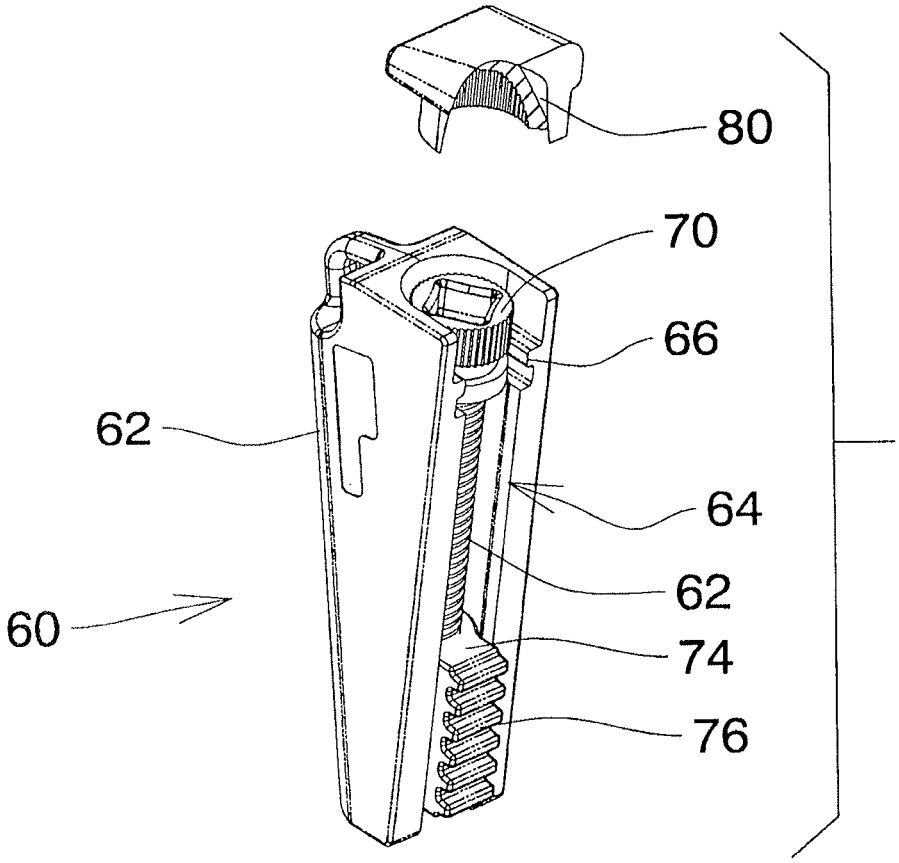
FIG. 5 is an isometric of the wedge and wedge block and cap.
Figure 6:
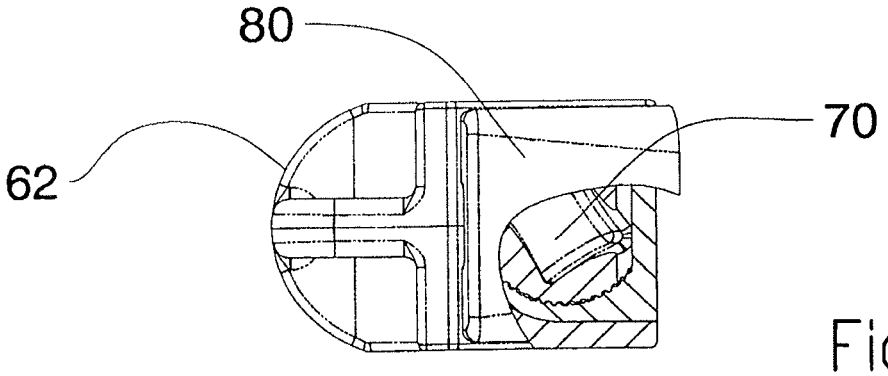
FIG. 6 is a partly cut away view top plan of the plastic cap.

A further embodiment of the invention is illustrated in FIGS. 4, 5 & 6.

In these illustrations, the basic components, namely the tooth retention device (16), and the C clamp (32), are retained. However in this embodiment the wedge member is illustrated as (60). The wedge member (60) has a wedge body (62) tapering from a wide upper end to a narrower lower end. The wedge body (62) has a generally u-shaped channel (64).

At the upper end of the channel (64), there is a semi-annular ridge (66) forming a collar.

Within the channel (66), there is a threaded rod (68). The rod (68) has a head portion (70) with an annular groove (72) formed around it, to receive the ridge (66).

A block nut (74) is threadedly received on the threaded rod (68). The block nut (74) has a ridged rack portion (76) extending therefrom normal to the axis of the nut (74)

The C clamp (32) in this embodiment is somewhat modified. It has a clamp rack portion (78) formed thereon, extending upwardly and downwardly, and receiving rack (76) of the block nut (74).

In operation, in this embodiment, the threaded rod is first of all rotated so as to drive the block nut down to the lower most point on the rod. The wedge member is then inserted, in the same way as before in the previous embodiment, seating against the lip of the shovel. The threaded rack portion (76) on the block nut (74), will engage the lower most ridges of the clamp rack portion (78) on the C clamp (32). The rod (68) is then rotated, by a suitable tool such as an alien key (not shown). This will cause the block nut (74) to progress up the threaded rod (68). However since the block nut rack portion (76) is engaging the rack portion (78) of the C-clamp (32), the block nut (74) cannot move upwardly. Consequently, such rotation of the rod will drive the entire wedge member (60) downwardly, thereby forcing it against one surface of the lip (12), and at the same time urging the C clamp (32) rearwardly against the other surface of the lip. In this way the retention device is held securely in position.

For the sake of security, a cap (80) typically formed of resilient synthetic plastic material or the like, will be press fitted onto the top of the nut (74), thereby preventing it from rotating. At the same time it will prevent the entry of foreign matter, which might damage the key surfaces on the nut head, and make it difficult to remove. Such a cap is also used in the embodiment of FIGS. 2 and 3.

The cap (80) has internal ridges formed to inter-engage with grooves on the head of the rod. This will resist any tendency for the threaded rod not to be loosened during use.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A tooth retention device for use with a bucket, comprising:

a main body having:

a tooth support located at a first end;

upper and lower arms spaced apart from each other at a second end; and slots formed within the upper and lower arms that are configured to register with an opening in the bucket;

a C-shaped clamp configured to be disposed within the slots of the upper and lower arms and the opening in the bucket;

a wedge configured to be disposed within the slots of the upper and lower arms and the opening in the bucket, the wedge having a channel formed at a side adjacent the C-shaped clamp;

a wedge block configured to slide within the channel and engage the C-shaped clamp; and a rod configured to engage the wedge and the wedge block.

2. The tooth retention device of claim 1, wherein:

the rod is threadingly received within the wedge block;

the wedge includes an annular ridge located at a base end; and the rod includes an groove at a head end that is configured to receive the annular ridge of the wedge.

3. The tooth retention device of claim 1, wherein:

the C-shaped clamp has a recess along an outer surface oriented toward the edge; and the wedge block includes a portion that protrudes out of the channel of the edge and into the recess of the C-shaped clamp.

4. The tooth retention device of claim 3, wherein the portion of the wedge block that protrudes out of the channel of the wedge is configured to engage a corresponding portion of the C-shaped clamp at an end of the recess.

5. The tooth retention device of claim 3, wherein:

the C-shaped clamp includes a rack portion located within the recess; and the portion of the wedge block that protrudes out of the channel of the wedge includes a ridged rack that is configured to engage the rack portion of the C-shaped clamp.

6. The tooth retention device of claim 1, wherein:

distal ends of the upper and lower arms taper inward toward the slots; and the C-shaped clamp includes inner surfaces tapered to mate with the distal ends of the upper and lower arms and create a wedging fit of the upper and lower arms within the C-shaped clamp.

7. The tooth retention device of claim 1, wherein:

ends of the slots are generally aligned with each other in a first direction;

the C-shaped clamp has an outer end surface that is inclined relative to the first direction; and the wedge is configured to slide against the outer end surface at the side adjacent the C-shaped clamp.

8. The tooth retention device of claim 7, wherein the rod is disposed within the wedge at an angle generally aligned with the outer end surface of the C-shaped clamp.

9. A tooth retention device for use with a bucket having a bucket lip, comprising:

a main body configured to engage opposing sides of the bucket lip;

a clamp configured to pass through the main body and the bucket lip;

a wedge configured to pass through the main body and the bucket lip at a location adjacent the clamp, the wedge having a channel formed therein; and a wedge block configured to slide within the channel and engage the clamp.

10. The tooth retention device of claim 9, wherein:

the clamp has a recess along an outer surface oriented toward the wedge; and the wedge block includes a portion that protrudes out of the channel of the wedge and into the recess of the clamp.

11. The tooth retention device of claim 10, wherein the portion of the wedge block that protrudes out of the channel of the wedge is configured to engage a corresponding portion of the clamp at an end of the recess.

12. The tooth retention device of claim 10, wherein:

the clamp includes a rack portion located within the recess; and the portion of the wedge block that protrudes out of the channel of the wedge includes a ridged rack that is configured to engage the rack portion of the clamp.

13. The tooth retention device of claim 9, wherein:

distal ends of the main body taper inward toward the clamp; and the clamp includes inner surfaces tapered to mate with the distal ends of the main body and create a wedging fit of the main body within the clamp.

14. The tooth retention device of claim 9, wherein:

the main body includes internal end walls at the clamp that are generally aligned with each other in a first direction;

the clamp has an outer end surface that is inclined relative to the first direction; and the wedge is configured to slide against the outer end surface at a side adjacent the clamp.

15. A tooth retention device for use with a bucket having a bucket lip, comprising:

a main body configured to engage opposing sides of the bucket lip;

a clamp configured to pass through the main body and the bucket lip;

a wedge configured to pass through the main body and the bucket lip at a location adjacent the clamp, the wedge including an annular ridge at a base end; and a rod disposed at an interface between the wedge and the clamp, the rod including a groove at a head end that is configured to receive the annular ridge of the wedge.

16. The tooth retention device of claim 15, wherein:

distal ends of the main body taper inward toward the clamp; and the clamp includes inner surfaces tapered to mate with the distal ends of the main body and generate a wedging fit of the main body within the clamp.

17. The tooth retention device of claim 15, wherein:

the main body includes internal end walls at the clamp that are generally aligned with each other in a first direction;

the clamp has an outer end surface that is inclined relative to the first direction; and the wedge is configured to slide against the outer end surface at a side adjacent the clamp.

18. The tooth retention device of claim 17, wherein the rod is disposed within the wedge at an angle generally aligned with the outer end surface of the clamp.

19. The tooth retention device of claim 15, wherein:

the wedge includes an annular ridge located at a base end; and the rod includes a groove at a head end that is configured to receive the annular ridge of the wedge.

* * * * *

UNITED STATES PATENT AND TRADEMARK OFFICE

CERTIFICATE OF CORRECTION

PATENT NO. : 8,720,088 B2
APPLICATION NO. : 13/914297
DATED : May 13, 2014
INVENTOR(S) : Garrett D. Knight It is certified that error appears in the above-identified patent and that said Letters Patent is hereby corrected as shown below:

In the Specification

Column 2, line 30, delete “cap;” and insert -- cap. --.

Column 2, line 59, delete “FIGS. 2 and 3;” and insert -- FIGS. 2 and 3. --.

Column 3, line 38, delete “it lowest” and insert -- its lowest --.

Column 3, line 38, delete “rod (46)” and insert -- rod (46). --.

Column 3, line 39, delete “(alien key” and insert -- (allen key --.

Column 3, line 67, delete “nut (74)” and insert -- nut (74). --.

Column 4, line 12, delete “alien key” and insert -- allen key --.

In the Claims

Column 4, line 63, in Claim 2, delete “an groove” and insert -- a groove --.

Column 4, line 67, in Claim 3, delete “edge;” and insert -- wedge; --.

Column 5, line 2, in Claim 3, delete “edge” and insert -- wedge --.

Signed and Sealed this
Fifteenth Day of September, 2015

Michelle K. Lee

Michelle K. Lee
*Director of the United States Patent and Trademark Office*